US005584131A

United States Patent [19]

Van Liempt et al.

[11] Patent Number: 5,584,131

[45] Date of Patent: Dec. 17, 1996

[54] DRIER WITH SHORTENED RESTART

[75] Inventors: Martinus J. C. Van Liempt, Arnhem; Gerardus C. J. Logtens, Holthees; Clemens J. M. De Vroome, Beugen, all of Netherlands

[73] Assignee: Stork Contiweb B.V., Boxmeer, Netherlands

[21] Appl. No.: 186,514

[22] Filed: Jan. 26, 1994

[30] Foreign Application Priority Data

Feb. 1, 1993 [NL] Netherlands ..... 9300199

[51] Int. Cl.[6] ..... F26B 17/00; F26B 9/00

[52] U.S. Cl. ..... 34/576; 34/640

[58] Field of Search ..... 34/629, 633, 640, 34/639, 649, 213, 214, 576

[56] References Cited

FOREIGN PATENT DOCUMENTS

| | | |
|---|---|---|
| 0066661 | 12/1982 | European Pat. Off. . |
| 0132498 | 2/1985 | European Pat. Off. . |
| 0303887 | 2/1989 | European Pat. Off. . |
| 0326227 | 8/1989 | European Pat. Off. . |
| 3312704 | 10/1983 | Germany . |
| 4033637 | 4/1992 | Germany . |
| 2147629 | 5/1985 | United Kingdom . |
| 2181165 | 4/1987 | United Kingdom . |
| 2194030 | 2/1988 | United Kingdom . |

*Primary Examiner*—Denise Gromada
*Assistant Examiner*—Susanne C. Tinker
*Attorney, Agent, or Firm*—Evenson, McKeown, Edwards & Lenahan, P.L.L.C.

[57] ABSTRACT

The invention relates to a drier for printed strips, comprising a housing through which the printed strips are carried, means for supporting the strip, a feed means for feeding heated gas to the housing, a discharge means for discharging gas from the housing, and a recirculation device for recirculating the gas present in the housing during standstill of the strip, wherein the recirculation device has been adapted for maintaining recirculation parallel to the direction of movement of the strip. As a consequence of these features the temperature prevailing in the space in the housing is kept substantially uniform during standstill of the strip. By maintaining the operating temperature there is hardly any need for temperature increase to take place during the start-up procedure, so that this procedure will proceed quickly.

9 Claims, 2 Drawing Sheets

DRIER WITH SHORTENED RESTART

The invention relates to a drier for printed strips, comprising a housing through which the printed strips are carried, means for supporting the strip, a feed means for feeding heated gas to the housing and a discharge means for discharging gas from the housing.

Such driers are generally known, among others from the Dutch patent application number 8902825.

For various reasons the printing process in which the drier plays a part may have to be interrupted temporarily. During such an interruption the printed strip comes to a standstill and doors present in the drier are usually opened so that the temperature level in the drier is reduced and the danger of loss of quality of the printed strips avoided. Embrittlement of the strip is a reduction in quality which can cause breakage of the strip.

As a result of this decrease in temperature it takes some time on restarting of the printing process before a stable final temperature is reached. In the burner according to the above mentioned specification a rapid start-up is obtained by overcapacity of the burner, although deterioration in the quality of the strip is not hereby avoided.

During this restart process the strip, usually formed by paper, is already running, since it would otherwise also deteriorate greatly in quality, whereby waste is produced during the start-up process. This waste represents a considerable cost item. It is generally the case in the production of printed material that the paper costs amount to the largest portion of the total costs, wherein with a start-up process duration of about 20 seconds and a—normal—speed of 10 m/s, a length of 200 m paper is lost as waste.

From the British patent specification number 2 159 615 a drier is known, comprising a housing through which the printed strips are carried, means for supporting this strip, supply means for supplying heated gas to the housing and discharge means for discharging gas from the housing, and a recirculation device for recirculating the gas present in the housing during standstill of the strip.

These steps prevent heated gas from being discharged to the outside so that a considerable temperature decrease is prevented, while a uniform temperature distribution is also realized by the recirculation which takes place.

The circulation with this prior art drier, however, takes place only in substantially the transverse direction, that is transverse to the direction of movement. Thus, a uniform temperature distribution is only realized in the transverse direction.

The aim of the present invention is to provide an apparatus in which during standstill of the strip also in the longitudinal direction, that is in the direction of movement of the strip, a uniform distribution of the temperature is developed, so that the development of local higher temperatures during standstill of the strip is avoided.

This aim is reached in that the recirculation apparatus has been adapted for maintaining recirculation parallel to the direction of movement of the strip.

The invention will be elucidated hereinbelow with reference to the annexed drawings, in which.

Figure 1:
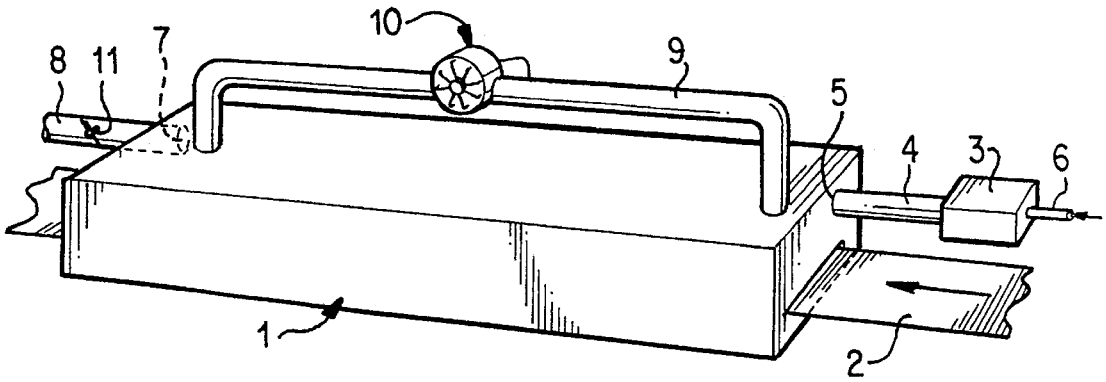
FIG. 1 shows a diagram of a first embodiment of a drier according to the invention.

In the embodiment depicted in FIG. 1 the drier 1 is represented schematically by a block. A strip 2 for drying is carried through the drier. The drier further comprises an externally arranged burner 3 which provides heated air by means of a duct 4 with feed opening 5. Burner 3 is further provided with a feed duct 6 for supply of combustion air. Drier 1 is further provided with an outlet opening 7 for discharge of air from the drier 1. This outlet opening 7 debouches into an outlet duct 8. Further arranged is a recirculation duct 9 which extends from the one side of the housing to the other side. A fan 10 is situated in the recirculation duct.

A valve 11 is arranged in outlet duct 8. During normal operation of this drier the burner 3 is switched on and the combustion gases coming from burner 3 are supplied to drier 1. On the other side of drier 1 the vapours saturated with the evaporated oils and solvents are removed and discharged via outlet duct 8. No recirculation through the recirculation duct 9 herein takes place.

During standstill of the drier the burner 3 is likewise switched on, but at a much lower power; this is only great enough to maintain the temperature inside the drier at the desired level. The gases coming from burner 3 are fed via feed duct 4 to the feed opening 5 where they enter the drier 1. The gases are partially discharged via outlet opening 7 and outlet duct 8; the flow rate is also determined by the valve 11.

The hot gases from the drier are recirculated in that by means of a fan 10 gases are extracted from the drier via the recirculation duct 9 and these gases are supplied again to the drier at another location. This recirculation results in a uniform temperature distribution inside drier 1, so that local extreme heating, and therewith igniting of the strip or embrittling thereof, is prevented. It is thus possible to maintain the general temperature level inside the drier at the operating temperature.

Figure 2:
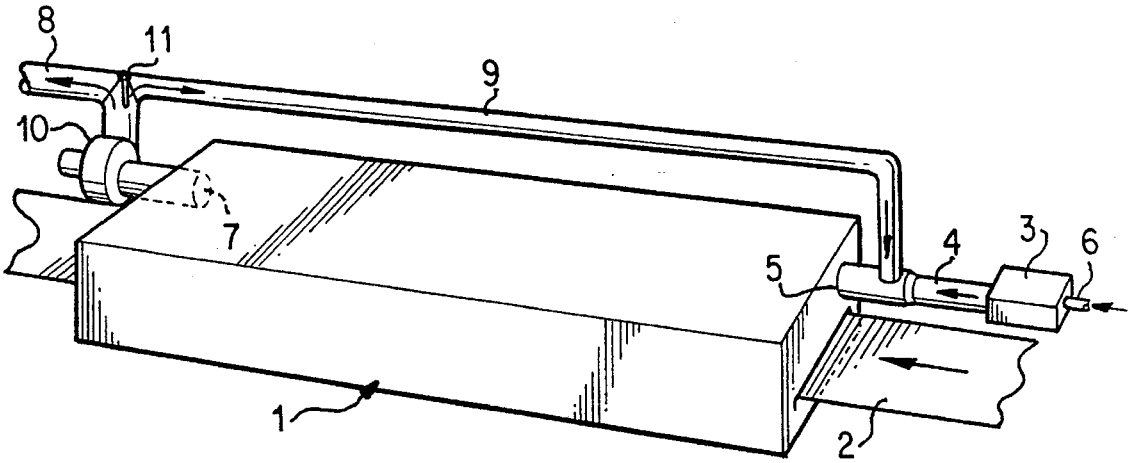
FIG. 2 shows a diagram of a second embodiment of a drier according to the invention.

The embodiment shown in FIG. 2 differs from the embodiment shown in FIG. 1 in the configuration of the ducts. The operation is however wholly identical. Valve 11 is here a three-way valve.

Figure 3:
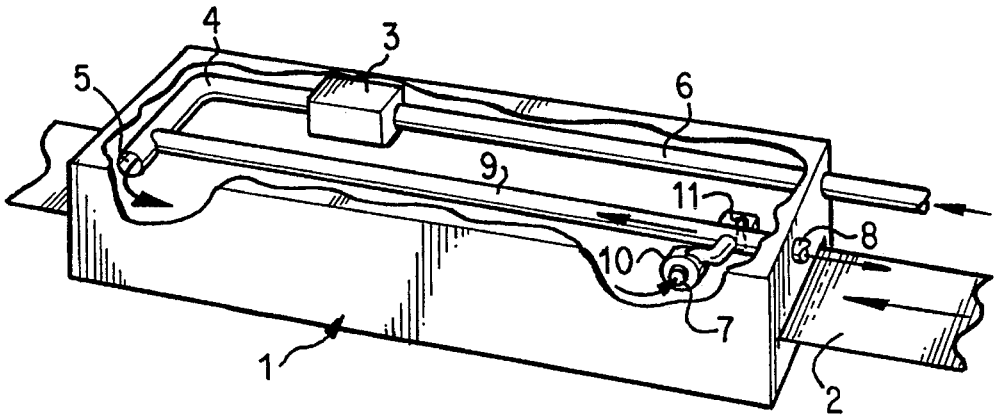
FIG. 3 shows a diagram of a third embodiment of a drier according to the invention.

The embodiment shown in FIG. 3 only differs from the embodiments shown in FIG. 1 and 2 in the fact that the burner 3 is situated inside the actual drier 1. Corresponding components in these embodiments are otherwise designated by corresponding reference numerals. The operation of the device shown in FIG. 3 corresponds wholly with the operation of the device shown in FIG. 1 and 2.

Figure 4:
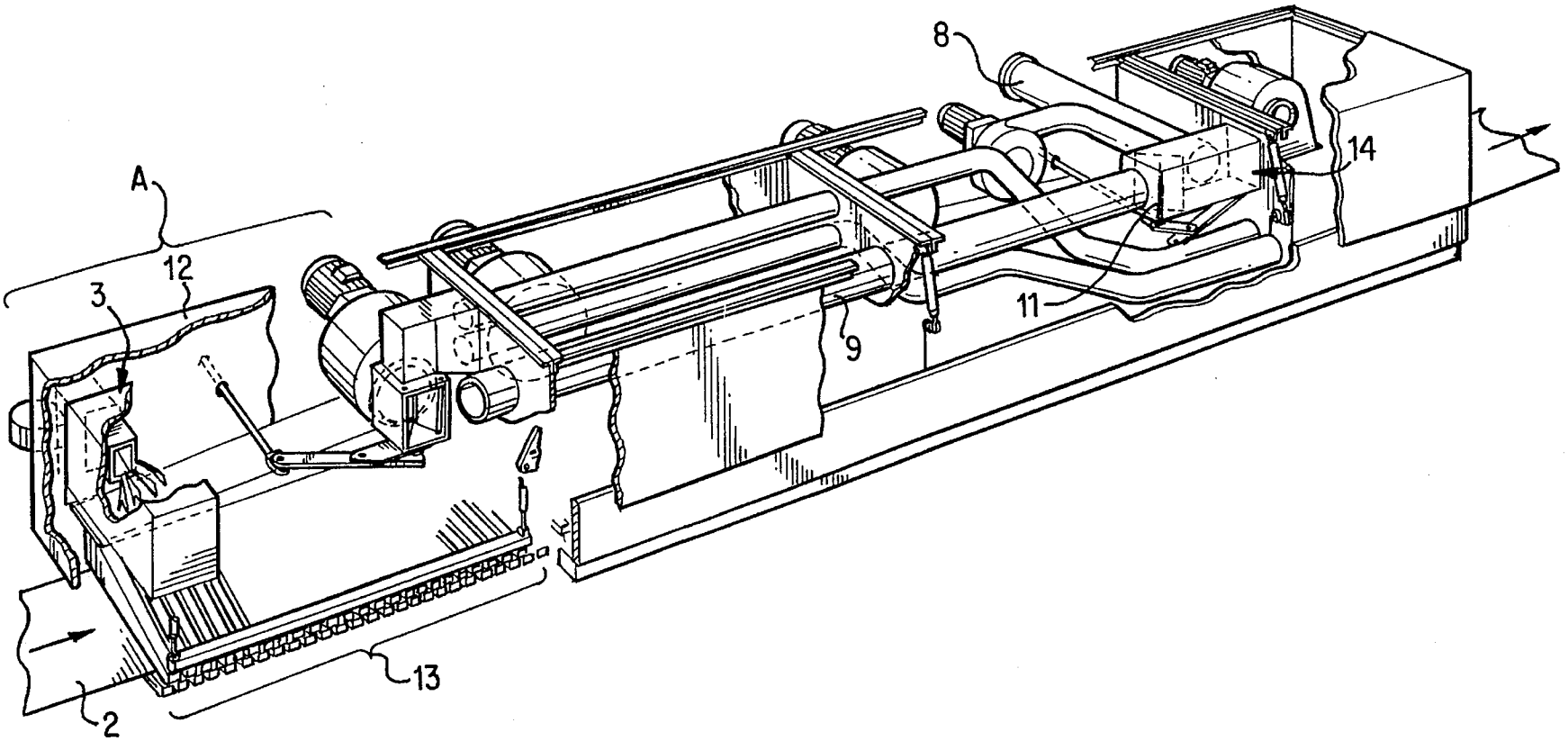
FIG. 4 shows a partly broken away perspective part view of a drier according to the invention.

Finally, FIG. 4 shows a partly broken away perspective view of such a device. Such a device comprises a housing 12 inside which two layers of nozzles 13 are arranged and inside which fans are arranged to maintain a circulation within separate units inside the drier. Such a drier, in which however the invention is not applied, is otherwise described more extensively in the Dutch patent application number 8902825, to which reference is made. In the housing of the drier is further arranged a burner 3, while recirculation duct 9 debouches into the space where burner 3 is present. The other side of recirculation duct 9 is connected to a valve housing 14 in which is arranged a three-way valve 11. Further shown in this drawing is the outlet duct 8 for gas for discharging.

We claim:

1. Drier for printed strips, comprising a housing having a longitudinal length through which the printed strips are carried in a longitudinal direction, means for supporting the strip, a feed means for feeding heated gas to the housing, a discharge means for discharging gas from the housing, and a distribution means for providing a uniform temperature distribution along said longitudinal length said distribution means comprising a recirculation device which recirculates the gas and solvents present in the housing during standstill of the strip in a direction parallel to the longitudinal direction.

2. Drier as claimed in claim 1, wherein the recirculation device is formed by a pipe leading from the one side to the opposite side of the housing.

3. Drier as claimed in claim 1, wherein the feed means and the discharge means are placed such that the flow direction of the gases during normal operation is the same as the direction of movement of the strip.

4. Drier as claimed in claim 1, wherein the feed means is connected to a burner.

5. Drier as claimed in claim 4, wherein the burner is placed in the housing.

6. Drier as claimed in claim 1, wherein the recirculation device is formed by a pipe which leads from the discharge means to the feed means and which is provided with at least one valve.

7. Drier as claimed in claim 6, wherein the valve is formed by a three-way valve placed at the outlet.

8. Drier as claimed in claim 4, wherein the burner is connected to an air feed line in which a valve is arranged, which valve is partially opened during stand-still of the drier to supply air to the burner.

9. Drier as claimed in claim 2, wherein a fan is arranged in the pipe.

* * * * *